US011213063B2

(12) United States Patent
Dominiak et al.

(10) Patent No.: US 11,213,063 B2
(45) Date of Patent: Jan. 4, 2022

(54) CENTERING DEVICE FOR ROD SHAPED ARTICLES OF THE TOBACCO INDUSTRY

(71) Applicant: PHILIP MORRIS PRODUCTS S.A., Neuchatel (CH)

(72) Inventors: Ryszard Dominiak, Warsaw (PL); Andrzej Boleslawski, Radom (PL); Michal Deka, Radom (PL)

(73) Assignee: Philip Morris Products S.A., Neuchatel (CH)

( * ) Notice: Subject to any disclaimer, the term of this patent is extended or adjusted under 35 U.S.C. 154(b) by 215 days.

(21) Appl. No.: 15/768,118

(22) PCT Filed: Oct. 17, 2016

(86) PCT No.: PCT/IB2016/056203

§ 371 (c)(1),
(2) Date: Apr. 13, 2018

(87) PCT Pub. No.: WO2017/068479

PCT Pub. Date: Apr. 27, 2017

(65) Prior Publication Data

US 2018/0310610 A1 Nov. 1, 2018

(30) Foreign Application Priority Data

Oct. 20, 2015 (PL) ..... 414414

(51) Int. Cl.
*A24C 5/32* (2006.01)
*A24C 5/12* (2006.01)
(Continued)

(52) U.S. Cl.
CPC ..... *A24C 5/327* (2013.01); *A24C 5/12* (2013.01); *A24C 5/28* (2013.01); *A24C 5/471* (2013.01); *A24C 5/478* (2013.01)

(58) Field of Classification Search
CPC ..... A24C 5/12; A24C 5/327
(Continued)

(56) References Cited

U.S. PATENT DOCUMENTS 3,036,581 A 5/1955 Dearsley
2,821,201 A * 1/1958 Brunswig ..... A24C 5/471 198/458

(Continued)

FOREIGN PATENT DOCUMENTS

CN 1073591 6/1993
CN 1882257 12/2006

(Continued)

OTHER PUBLICATIONS

Machine Translation of EP 1994838 (Year: 2008).*

(Continued)

*Primary Examiner* — Eric Yaary
*Assistant Examiner* — Russell E Sparks
(74) *Attorney, Agent, or Firm* — Mueting Raasch Group

(57) ABSTRACT

A method and an apparatus (1A, 1B, 1C, 1D, 1E) for axial centering of a rod-like article (3) or a group of rod-like articles wherein the rod-like article (3) or the group of rod-like articles is conveyed in a flute (4) situated on the circumference of a drum conveyor (5), moreover, the rod-like article (3) or the group of rod-like articles in the successive flutes (4) have the same or varying length, with the apparatus (1A, 1B, 1C, 1D, 1E) being provided with pusher elements (10, 13, 20, 23, 30, 33, 40, 43) of a shifting mechanism axially acting on the rod-like article (3) or the group of rod-like articles so as to change the position of the rod-like article (3) or the groups of articles in the flute (4), characterized in that the coupled pusher elements (10, 13, 20, 23, 30, 33, 40, 43) make swinging movements having opposite senses, moreover, the pusher elements (10, 13, 20, (Continued)

Figure 1:
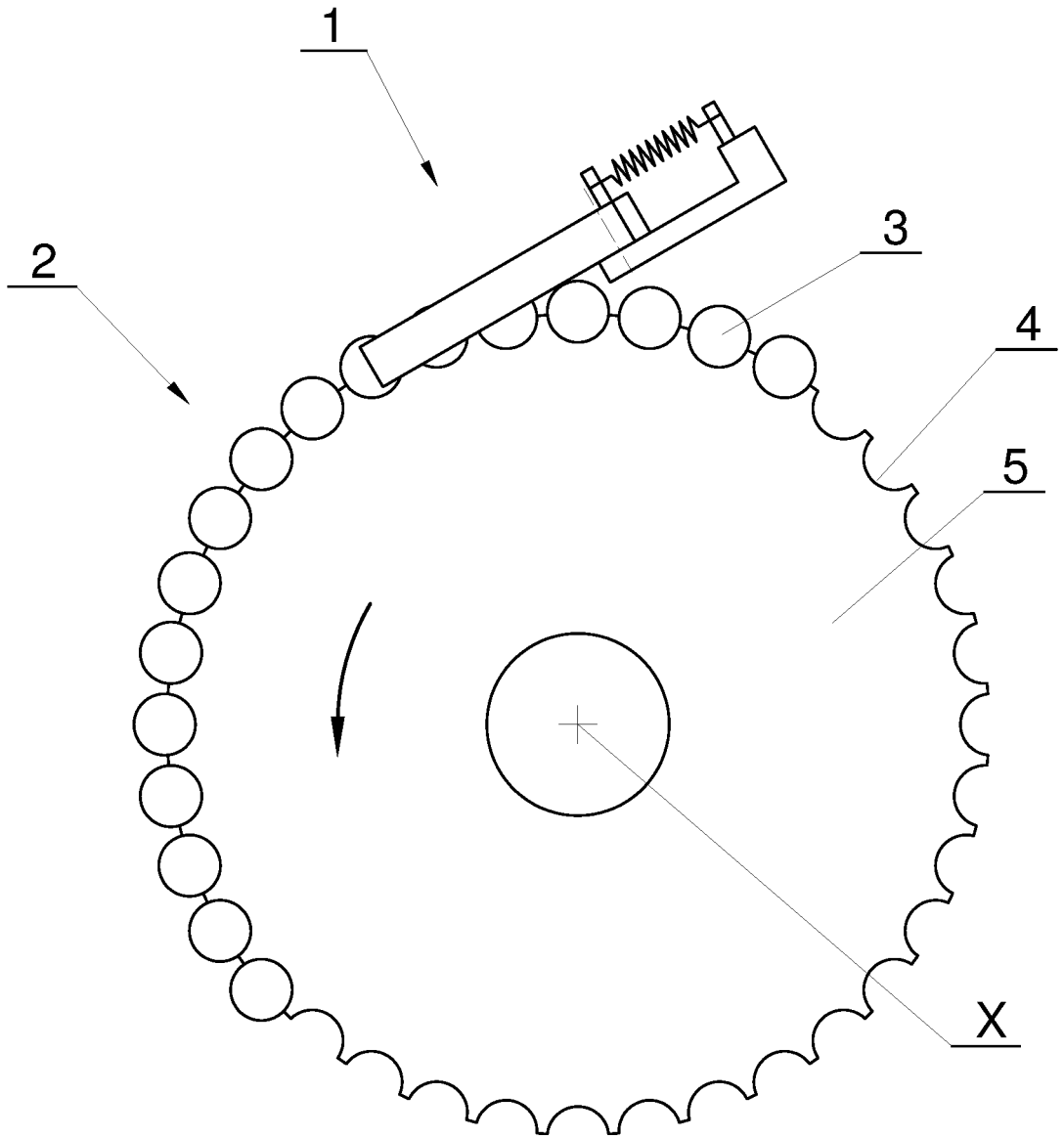

23, 30, 33, 40, 43) have contact surfaces (10A, 13A, 20A, 23A, 30A, 33A, 40A, 43A) adapted to axially act on the rod-like article (3) or the group of rod-like articles, the contact surfaces (10A, 13A, 20A, 23A, 30A, 33A, 40A, 43A) of the pusher elements (10, 13, 20, 23, 30, 33, 40, 43) being convergently positioned in the direction of movement (T) of the rod-like articles, at least one pusher element (10, 13, 20, 23, 30, 33, 40, 43) being connected with a dynamic element (6, 26, 37, 47) placing the pusher elements (10, 13, 20, 23, 30, 33, 40, 43) in a position enabling them to axially act on the rod-like articles (3, 3L, 3R) or the groups of rod-like articles conveyed on the drum conveyor (5) so that the centers of the rod-like articles (3) or the groups of rod-like articles are positioned principally in a common plane (S, SL, SR).

14 Claims, 11 Drawing Sheets

(51) Int. Cl.
*A24C 5/28* (2006.01)
*A24C 5/47* (2006.01)

(58) Field of Classification Search
USPC ..... 131/282
See application file for complete search history.

(56) References Cited

U.S. PATENT DOCUMENTS

| | | | | | |
|---|---|---|---|---|---|
| 3,089,576 | A * | 5/1963 | Sauer | B65B 27/06 | 198/634 |
| 3,102,627 | A * | 9/1963 | Acton | B65G 37/00 | 198/345.1 |
| 3,343,676 | A | 9/1967 | Szabo | | |
| 3,478,632 | A | 11/1969 | Schmermund | | |
| 3,815,612 | A * | 6/1974 | Molins | A24C 5/478 | 131/94 |
| 4,325,250 | A | 4/1982 | Bolt | | |
| 4,605,014 | A | 8/1986 | Wahle | | |
| 5,402,802 | A | 4/1995 | Kakiuchi | | |
| 5,566,811 | A | 10/1996 | Draghetti | | |
| 6,425,400 | B1 | 7/2002 | Krause | | |
| 7,296,579 | B2 | 11/2007 | Focke | | |
| 7,837,025 | B2 | 11/2010 | Bertinelli | | |
| 10,159,274 | B2 * | 12/2018 | Ostrzyzek | B65G 47/28 | |
| 10,375,987 | B2 * | 8/2019 | Boleslawski | A24C 5/471 | |

FOREIGN PATENT DOCUMENTS

| | | | | |
|---|---|---|---|---|
| CN | 101254029 | | 9/2008 | |
| DE | 1008173 | | 5/1957 | |
| EP | 0674853 | | 10/1995 | |
| EP | 0577061 | | 3/1996 | |
| EP | 0580150 | | 2/1997 | |
| EP | 0627175 | | 11/1998 | |
| EP | 1994838 | A1 * | 11/2008 | A24C 5/478 |
| FR | 2455438 | | 11/1980 | |
| GB | 1374784 | A * | 11/1974 | A24C 5/322 |
| GB | 2494159 | | 3/2013 | |
| JP | S48-040979 | | 5/1973 | |
| JP | S57-169727 | | 10/1982 | |
| JP | S59-017973 | | 2/1984 | |
| JP | S59-098675 | | 7/1984 | |
| JP | S61-206518 | | 12/1986 | |
| JP | H07-309429 | | 11/1995 | |
| JP | H10-152216 | | 6/1998 | |
| JP | 2000-245428 | | 9/2000 | |

OTHER PUBLICATIONS

PCT Search Report and Written Opinion for PCT/IB2016/056203 dated Feb. 8, 2017 (9 pages).
Office Action issued in Russian for Application No. 2018118189/17 dated Oct. 30, 2019 (19 pages). English translation included.
Office Action issued in China for Application No. 201680059209.2 dated Aug. 18, 2020 (6 pages). English translation included.
Office Action issued in Japan for Application No. 2018-520154 dated Oct. 12, 2020 (3 pages). English translation included.

* cited by examiner

CENTERING DEVICE FOR ROD SHAPED ARTICLES OF THE TOBACCO INDUSTRY

This application is a U.S. National Stage Application of International Application No. PCT/IB2016/056203, filed Oct. 17, 2016, which was published in English on Apr. 27, 2017, as International Publication No. WO 2017/068479 A1. International Application No. PCT/IB2016/056203 claims priority to Polish Application No. PL414414 filed Oct. 20, 2015.

The object of the invention is an apparatus and a method for axial centering of a rod-like article or a group of rod-like articles and a multi-stage unit for cutting a rod-like article or a group of rod-like articles. The object of the invention is used for rod-like articles and groups of rod-like articles conveyed in flutes of a drum conveyor in tobacco industry machines.

Drum conveyors for crosswise conveying of rod-like articles, provided on the circumference with multiple flutes situated parallel to the axis of rotation of the conveyors, are commonly used in the tobacco industry. Rod-like articles are understood as filter rods manufactured of a single kind of filter material, any rod-like products and semi-finished products of the tobacco industry comprising multi-segment filter rods containing filter segments, multi-segment filter rods containing filter segments and additional components altering or giving the articles' aroma, multi-segment filter rods containing filter segments and additional objects modifying the filter properties of filter materials used, multi-segment rods containing both filter and non-filter segments, multi-segment articles with reduced tobacco content, cigarettes without a mouth piece and cigarettes with a single-segment or multi-segment mouth piece stuck on. During the conveying in the flutes of the drum, rod-like articles are held in the flutes by means of negative pressure supplied by means of holes made in the flutes, whereas it is possible to convey one or multiple rod-like articles in one flute. Due to the production process it is necessary during the rotational movement of drum conveyors to shift rod-like articles axially that is along the flutes of drum conveyors so as to obtain repeatable positions of individual articles relative to front surfaces of the drum itself and of other units of the machine. The articles are shifted among others to achieve repeatable positions of rod-like articles relative to the plane of a rotary knife or multiple rotary knives provided for cutting of rod-like articles. The cutting of conveyed articles in the form of filter-rods or article groups in the form of filter and tobacco rods joined by means of the wrapping material takes place on machines for the manufacture and joining of filter and tobacco portions of cigarettes.

In the tobacco industry, devices for shifting of rod-like articles in the flutes of drum conveyors are known from the prior art. For example, a device for centering of groups of rod-like articles is known from publication DE1008173, whereas such article group consists of one filter portion and two tobacco portions. Each of the portions is made with a certain length tolerance so that each group may have a slightly different total length being a sum of lengths of individual articles. The device is provided with two centering rings and is designed for correct centering of a group with a maximum total length, other groups will not be centered which will be apparent in the difference in length of two portions which will be formed by cutting conveyed groups once they have been wrapped in a tipping paper joining the filter and tobacco portions. The U.S. Pat. No. 3,343,676 describes a device for the shifting of article groups by means of single pushers where the article groups are positioned relative to the plane at one of the ends of article groups. Opposite ends of article groups will be positioned depending on the total length of the article group. The U.S. Pat. No. 3,036,581 presents a centering device for centering a group of rod-like articles, whereas similar to the previous solution the groups are shifted to one side, which results in uneven cutting of the central element of an article group. In each of the devices described above it is not possible to cut all article groups into two parts with the same length.

The objective of this invention is to develop a centering apparatus for the centering of articles conveyed transversely to the axis of rod-like articles on a drum conveyor which would allow centering of all conveyed articles irrespective of their length, i.e. such positioning of rod-like articles or groups of rod-like articles that their geometric centers would be situated in one plane.

The object of the invention is an apparatus for axial centering of a rod-like article or a group of rod-like articles wherein the rod-like article or the group of rod-like articles is conveyed in a flute situated on the circumference of a drum conveyor, and the rod-like article or the group of rod-like articles in the successive flutes of the drum conveyor may have the same or varying length, moreover, the apparatus is provided with pusher elements of a shifting mechanism axially acting on the rod-like article or the group of rod-like articles so as to change the position of the rod-like article or the group of rod-like article in the flute. The apparatus according to the invention is characterized in that the coupled pusher elements make swinging movements having opposite senses, moreover, the pusher elements have contact surfaces adapted to axially act on the rod-like article or the group of rod-like articles, the contact surfaces of the pusher elements being convergently positioned in the direction of movement of the articles, at least one pusher element being connected with a dynamic element placing the pusher elements in a position enabling them to axially act on the rod-like articles or the groups of rod-like articles conveyed on the drum conveyor so that the centers of the rod-like articles or the groups of rod-like articles are positioned principally in a common plane.

The apparatus according to the invention is characterized in that the pusher elements are coupled by means of toothed wheel sectors.

The apparatus according to the invention is characterized in that the pusher elements are coupled by means of a lever coupling.

The apparatus according to the invention is characterized in that the pusher elements are coupled by a dynamic element.

The apparatus according to the invention is characterized in that the dynamic element is configured so that the contact surfaces of the pusher elements are shifted towards the ends of the rod-like article.

The apparatus according to the invention is characterized in that the pusher elements make swinging movements in the range between 0.5° and 6°.

The apparatus according to the invention is characterized in that the dynamic element is an element selected from a group comprising a spring, a pneumatic element and a magnet.

The apparatus according to the invention is characterized by further comprising immovable guides situated on two sides of the drum conveyor and configured so that the rod-like articles or the groups of rod-like articles are provisionally positioned before the contact with the contact surfaces.

The apparatus according to the invention is characterized by further comprising rotary knives situated so that they cut the rod-like articles or the groups of rod-like articles after their centers have been positioned in a common plane.

The apparatus according to the invention is characterized in that the rotary knives provided to cut the rod-like articles or the groups of rod-like articles are situated behind the pusher elements.

Furthermore, the object of the invention is a multi-stage unit for cutting rod-like articles of the tobacco industry wherein a rod-like article or a group of rod-like articles is conveyed in a flute situated on the circumference of the drum conveyor and is cut by means of a rotary knife, moreover, the rod-like article or the group of rod-like articles in the successive flutes have the same or varying length. The unit according to the invention is characterized by being provided with a first centering apparatus according to the invention mating with a first rotary knife so that the rod-like article or the group of rod-like articles is cut in the centering plane into two parts or groups, left and right, the first centering apparatus and the first rotary knife forming a first-stage unit, at least one second centering apparatus according to the invention being placed behind the first centering apparatus so that it centers respectively at least one of the parts or groups, left or right, of the cut rod-like article or group of rod-like articles conveyed in the flute situated on the circumference of the drum conveyor, whereas the second centering apparatus respectively mates with the second rotary knife which cuts the rod-like articles respectively in the centering plane of such part or group, whereas the second centering apparatus and the second rotary knife form a second-stage unit.

The unit according to the invention is characterized in that at least two second-stage units disposed beneath the first-stage unit seeing in the direction of conveying of the rod-like articles are assigned to the first-stage unit.

The unit according to the invention is characterized in that the first-stage unit comprises a spacing module which spaces the cut parts of the rod-like article or the group of rod-like articles conveyed in the flute situated on the circumference of the drum conveyor disposed behind the rotary knife of the first-stage unit looking in the direction of conveying of the rod-like articles.

The unit according to the invention is characterized in that the rotary knife has surfaces provided to space the cut parts of the rod-like article or the groups of rod-like articles.

The object of the invention is also a method of axial centering of a rod-like article or a group of rod-like articles wherein the rod-like article or the group of rod-like articles is conveyed in a flute situated on the circumference of a drum conveyor, moreover, the rod-like article or the group of rod-like articles in successive flutes have the same or varying length, with pusher elements of a shifting mechanism axially acting on the rod-like article or the group of rod-like articles so as to change the position of the rod-like article or the group of rod-like articles in the flute. The method according to the invention is characterized in that the coupled pusher elements make swinging movements having opposite senses and the convergently positioned contact surfaces of the pusher elements axially act on the rod-like article or the group of rod-like articles, whereas by means of at least one pusher element connected with a dynamic element placing the pusher elements in a position enabling them to axially act on the rod-like articles or the groups of rod-like articles conveyed on the drum conveyor the centres of the rod-like articles or the groups of rod-like articles are positioned principally in a common plane.

The centering apparatus and the multi-stage unit for cutting the rod-like article according to the invention combine effective centering of conveyed rod-like articles and groups of rod-like articles with gentle handling of the articles.

Figure 2:
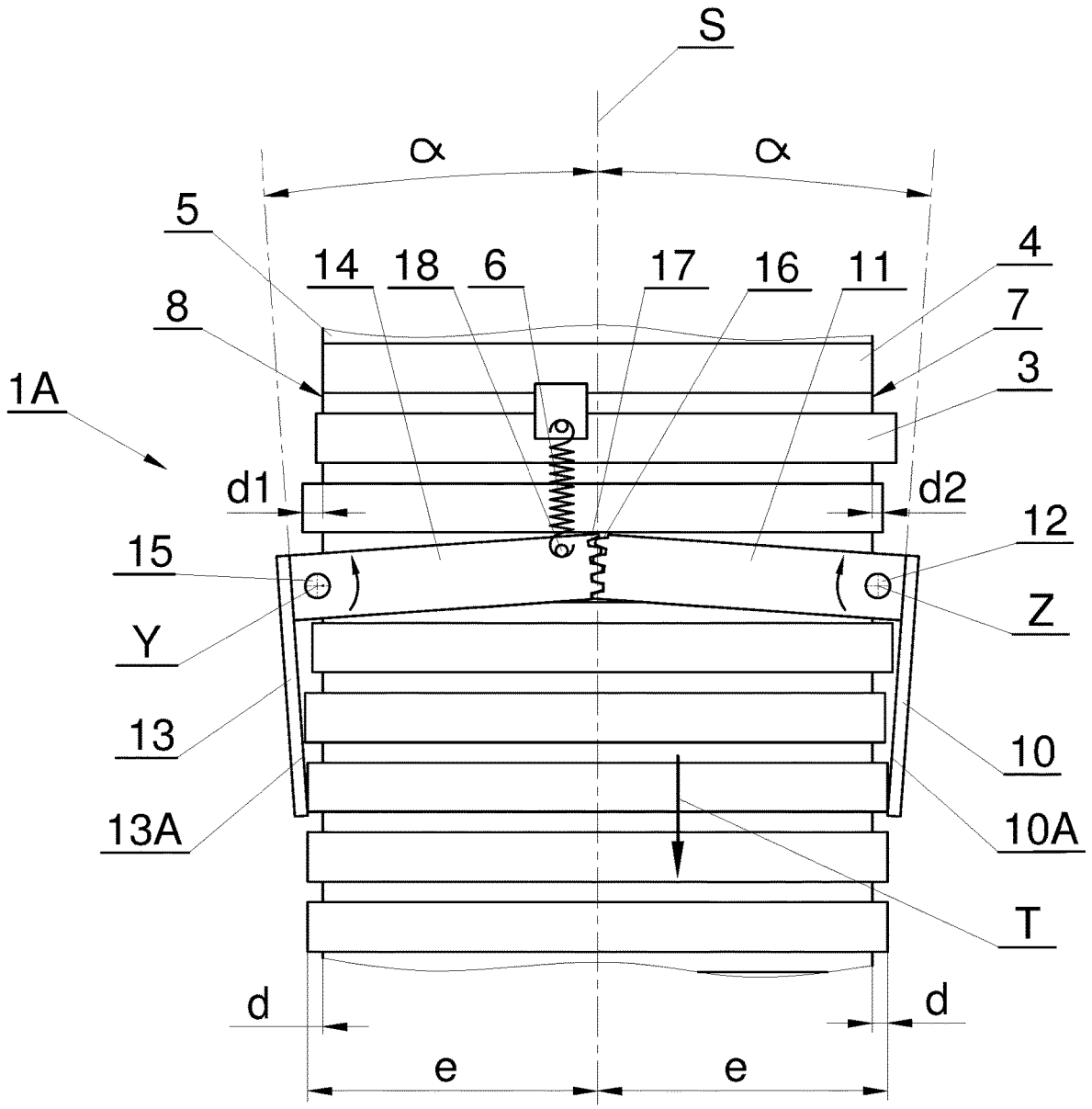
Figure 3:
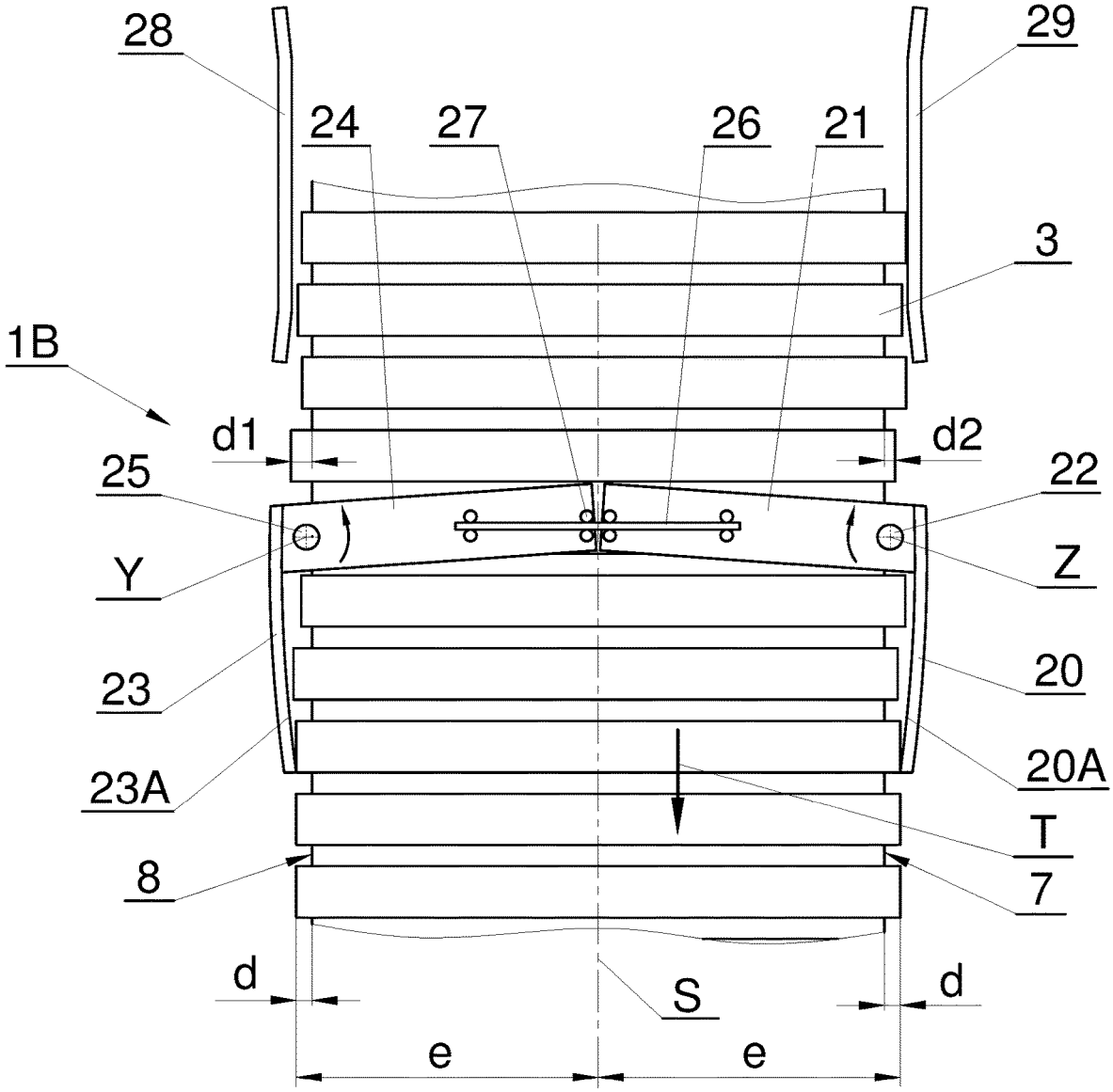
Figure 4:
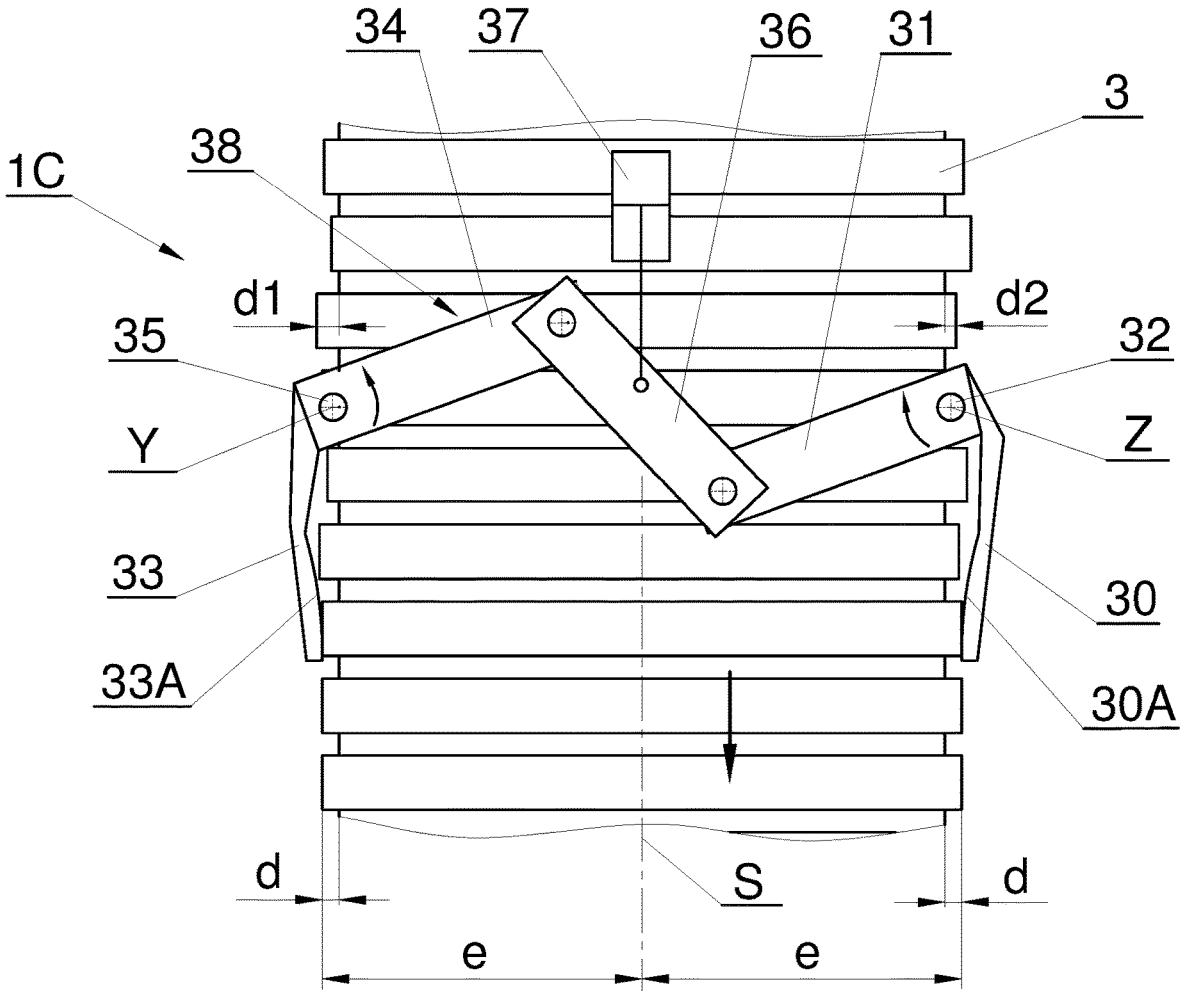
Figure 5:
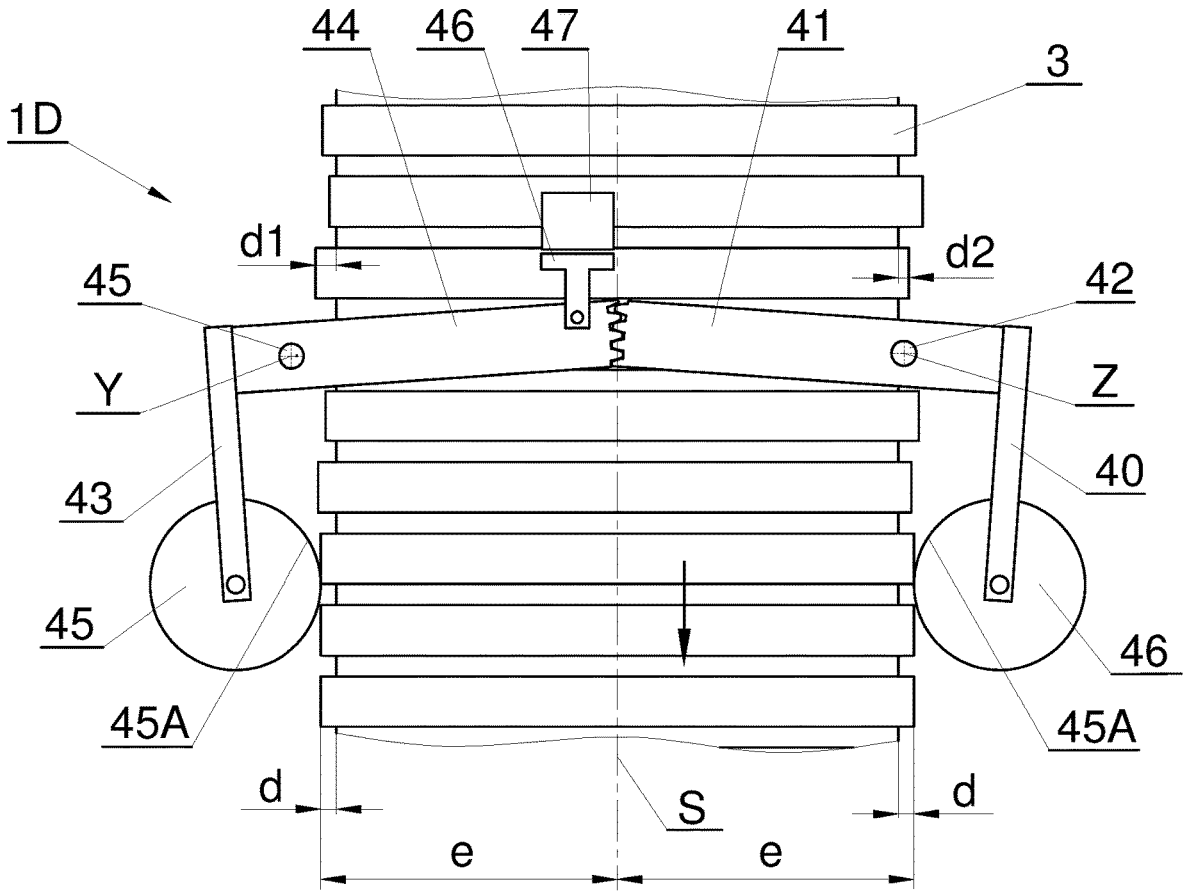
Figure 6:
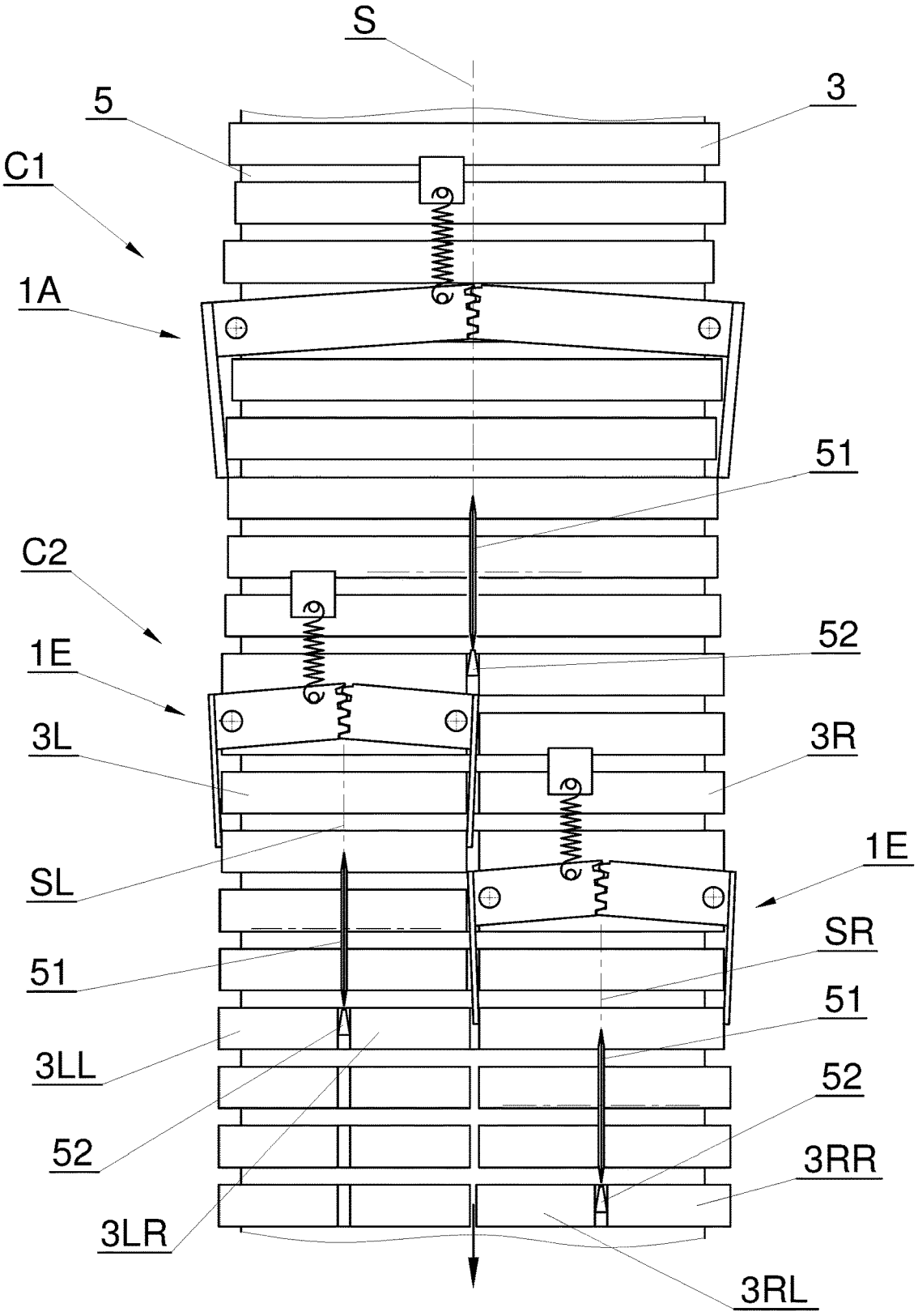
Figure 7:
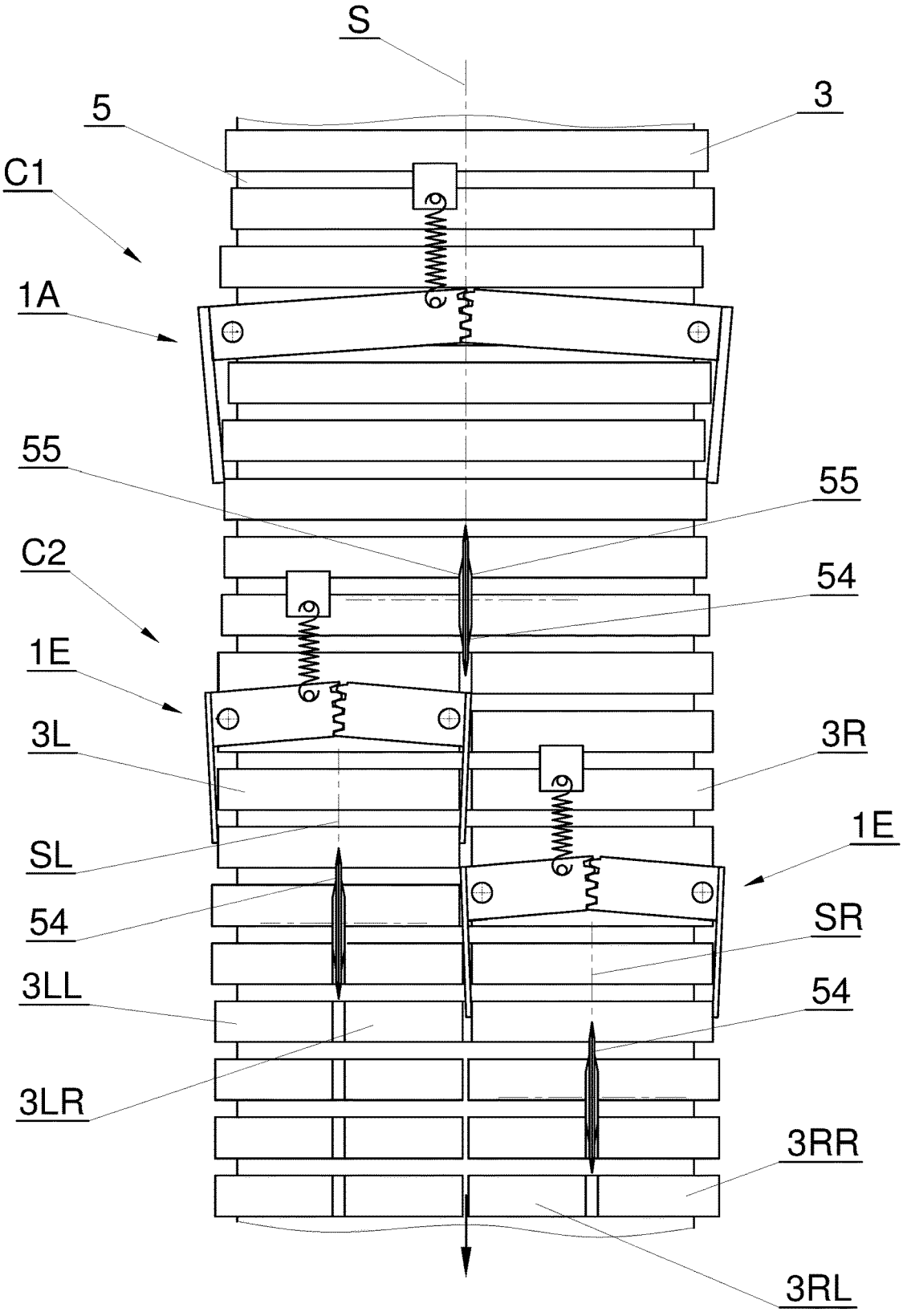
Figure 8:
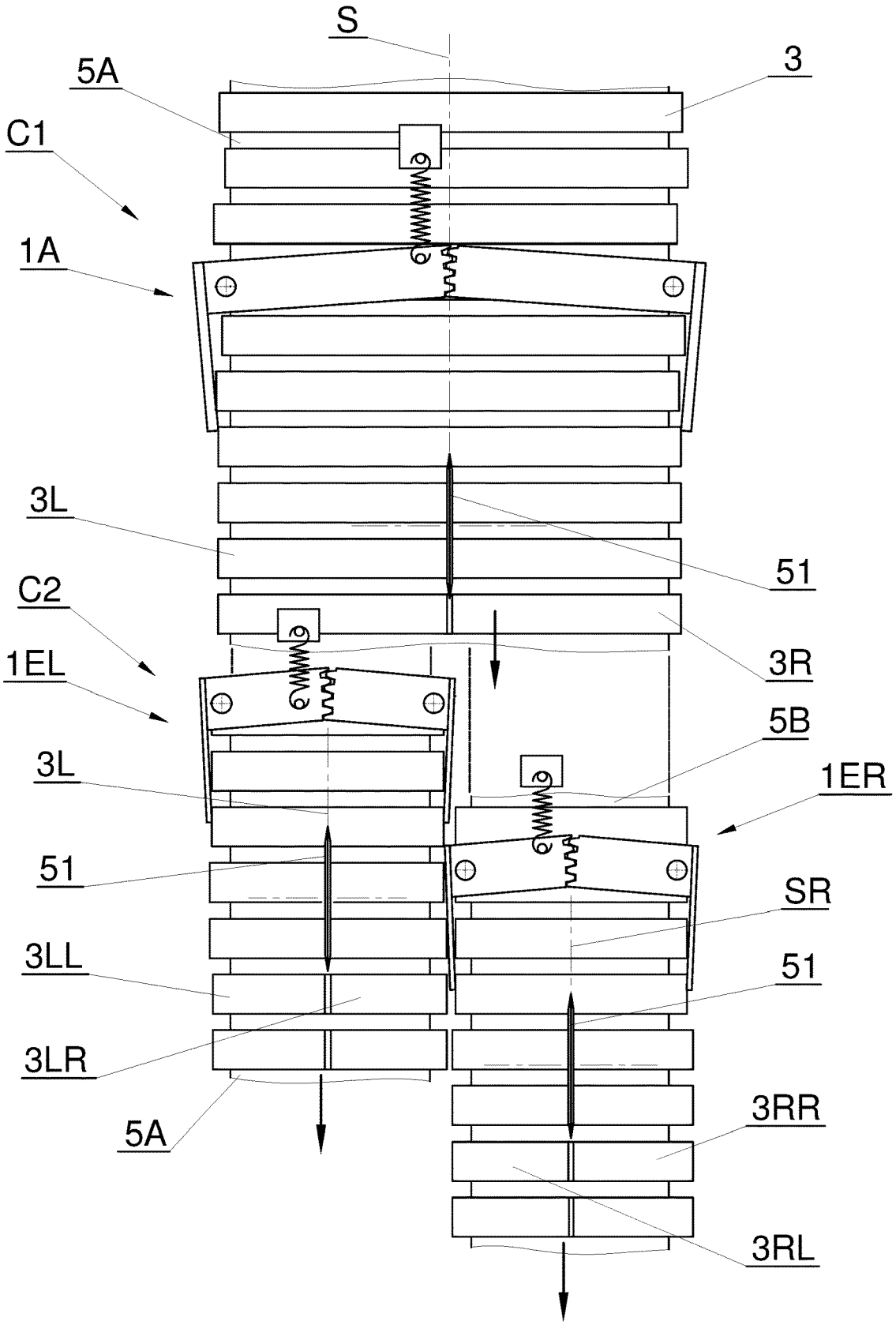
Figure 9:
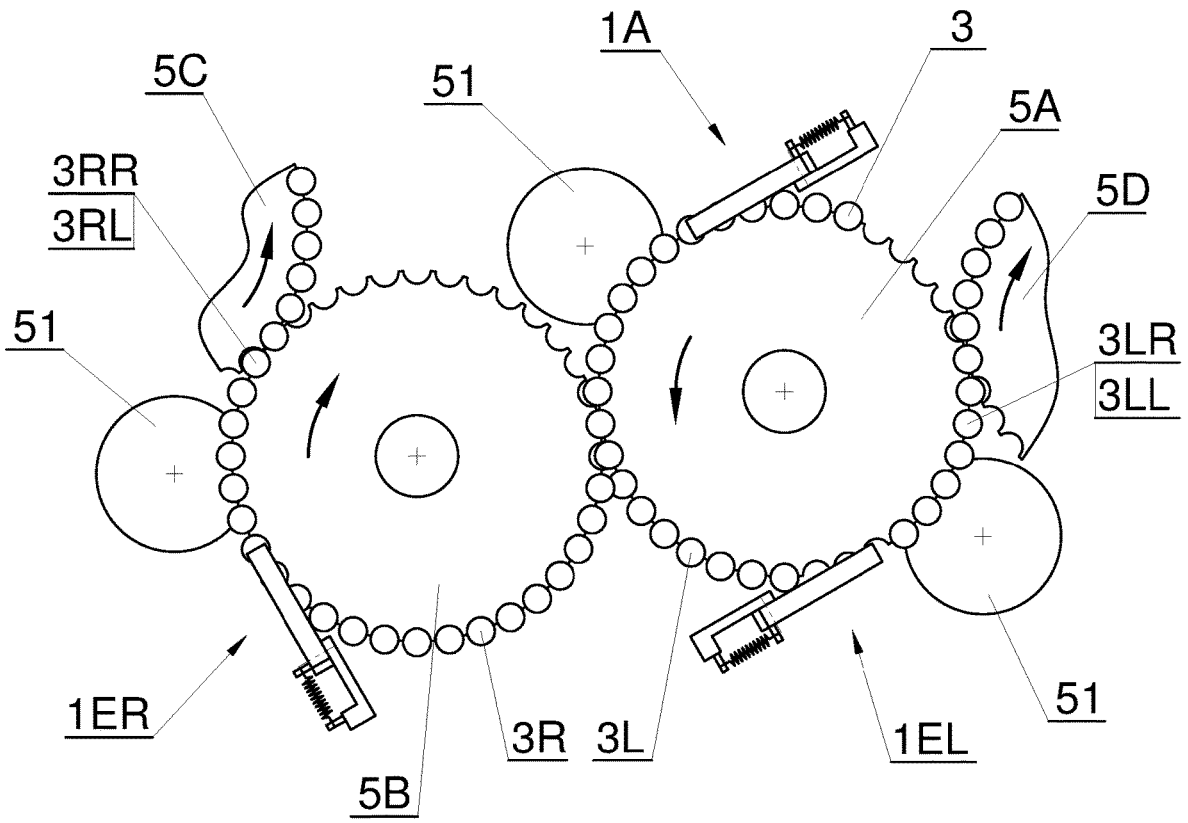
Figure 10:
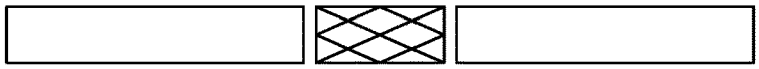
Figure 11:
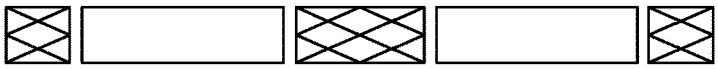
Figure 12:
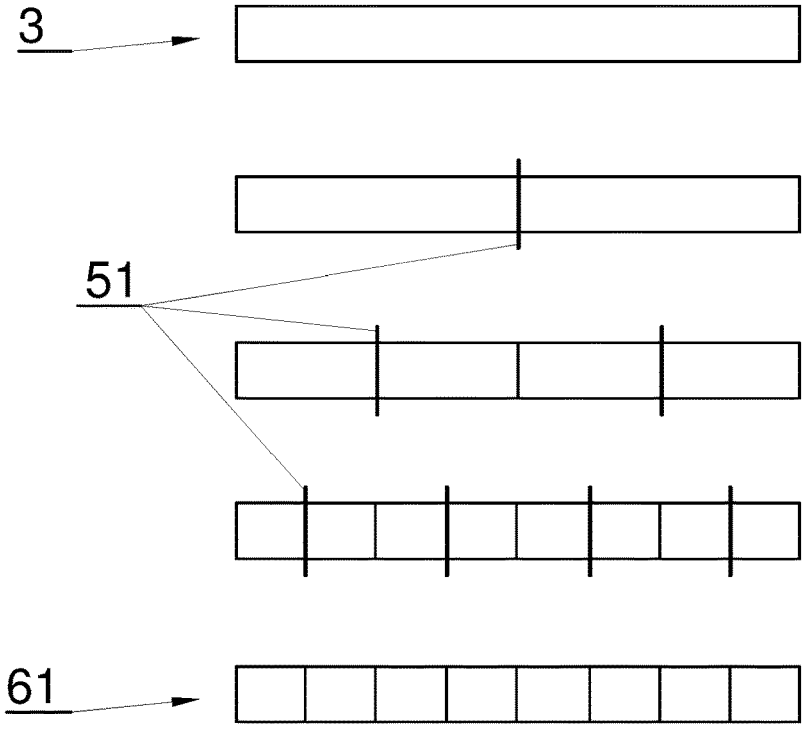
Figure 13:
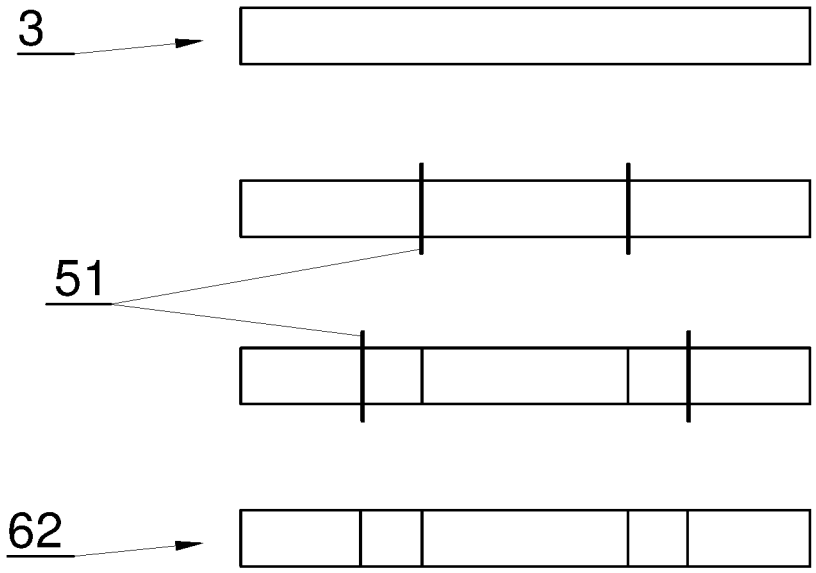

The object of the invention has been illustrated schematically in embodiments in a drawing in which FIG. 1 shows a fragment of a machine comprising a drum conveyor and a centering apparatus in a view in the direction of the axis of the drum conveyor, FIG. 2 shows a view of the centering apparatus in a first embodiment and a developed view of the lateral surface of the drum conveyor, FIG. 3 shows a view of the centering apparatus in a second embodiment and a developed view of the lateral surface of the drum conveyor, FIG. 4 shows a view of the centering apparatus in a third embodiment and a developed view of the lateral surface of the drum conveyor, FIG. 5 shows a view of the centering apparatus in a fourth embodiment and a developed view of the lateral surface of the drum conveyor, FIG. 6 shows a view of a multi-stage unit for cutting of rod-like articles in a first embodiment and a developed view of the lateral surface of the drum conveyor, FIG. 7 shows a view of the multi-stage unit for cutting of rod-like articles in a second embodiment and a developed view of the lateral surface of the drum conveyor, FIG. 8 shows a view of the multi-stage unit for cutting of rod-like articles in a third embodiment and a developed view of the lateral surface of the drum conveyor, FIG. 9 shows the multi-stage unit for cutting of rod-like articles in the third embodiment in a view in the direction of the axis of the drum conveyor, FIG. 10 shows a group of rod-like articles, FIG. 11 shows another group of rod-like articles, FIG. 12 shows an example of division of a rod-like article, FIG. 13 shows another example of division of a rod-like article.

A centering apparatus 1 according to the invention may be used for drum conveyors on tobacco industry machines. FIG. 1 shows a drum conveyor 2 comprising a drum 5 adapted to rotate around the axis of rotation X. The drum 5 has, on its circumference, multiple flutes 4 provided to convey rod-like articles 3 transversely to the axis of the rod-like articles 3, the flutes 4 being situated parallel to the axis of rotation X of the drum 5. The rod-like articles 3 are held in the flutes 4 by means of negative pressure supplied through holes made in the bottoms of the flutes 4. The centering apparatus 1 for axial centering of the rod-like article 3 in the flute 4 is situated above the drum 5, whereas the centering apparatus may take any position around the drum 5.

The centering apparatus 1A in a first embodiment shown in FIG. 2 is provided with two pusher elements 10 and 13 connected with swinging arms respectively 11 and 14 attached to pivots 12 and 15 attached to the machine body. The swinging arms 11 and 14 may make swinging movements around the axes Z and Y. The arms 11 and 14 are coupled with each other by means of toothed wheel sectors 16 and 17 so that the arms 11 and 14 may make swinging movements in opposite directions (the directions corresponding to the movement of the contact surfaces 10A and 13A towards the ends of the rod-like article 3 are shown with arrows in FIG. 1). A dynamic element in the form of a spring 6, which is attached to the machine body and causes the pressing of the contact surfaces 10A and 13A of the pusher elements respectively 10 and 13 against the ends of the rod-like article 3, acts on the hook attached to the arm 14, the contact surfaces 10A and 13A being situated convergently for the movement of the rod-like articles in the conveying direction T. The contact surfaces 10A and 13A are situated symmetrically to the symmetry plane S, with each such contact surface being deflected at an angle α.

The rod-like articles 3 may have varying lengths within a tolerance range allowable in the article manufacturing process. After placing the articles 3 in the flutes 4 of the drum 5, the geometric centers of the articles conveyed in the flutes 4 are not situated in one plane. The resultant position of the ends of the rod-like articles 3 relative to the lateral surfaces 7 and 8 of the drum 5 was described by way of example with the dimensions d1 and d2. During the movement of the rotary drum 5 in the conveying direction T, the ends of each rod-like article 3 come into contact with the convergently positioned contact surfaces 10A and 13A. The force exerted by the spring 6 acts on the arms 11 and 14 and is transferred by the pusher elements 10 and 13 through the contact surfaces 10A and 13A to the rod-like article 3, which causes the centering of the rod-like article 3, i.e. the geometric centers of individual articles will be situated in one plane S irrespective of the actual length of the articles. As a result of centering, the distances of the ends of the rod-like article 3 to the lateral surfaces 7 and 8 of the drum 5 will be equalized to the value d for both ends, and the ends will be equidistant from the symmetry plane S by the dimension e equal to a half of the article length. Due to a random initial location of the centers of the articles relative to the plane S and to varying lengths of the rod-like articles 3, the pusher elements 10 and 13 are swung to a different degree and make swinging movements in the range between 0.5° and 6°, whereas for a longer article and for an article being more asymmetrically placed in the flute of the drum the contact surfaces 10A and 13A act on the rod-like article with a greater force.

The centering apparatus 1B shown in FIG. 3 in a second embodiment is provided with the pusher elements 20 and 23 having concave contact surfaces respectively 20A and 23A acting on the ends of the rod-like articles 3. The pusher elements 20 and 23 are attached to the swinging arms 21 and 24 which are self-aligning and attached to the pivots 22 and 25. The swinging arms 21 and 24 are mechanically coupled with each other by means of a resilient element 26 whose position relative to the arms 21 and 24 is fixed by means of holding elements 27. A dynamic element in the form of the resilient element 26 in the form of a metal plate or a wire, apart from the coupling of the arms 21 and 24 ensuring making of swinging movements in opposite directions, ensures pressing of the contact surfaces 20A and 23A against the ends of the rod-like articles 3 because the bending of this resilient element 26 will cause an increase of the pressing force acting on the ends of the rod-like article 3. In this embodiment, the centering apparatus is further provided with two immovable guides 28 and 29 situated on two sides of the drum conveyor 2 and configured so that the rod-like articles 3 or the groups of rod-like articles are provisionally positioned in the flute 4 of the conveyor drum 5 before the contact with the contact surfaces 20A and 23A.

The centering apparatus 10 shown in FIG. 4 in a third embodiment is provided with the pusher elements 30 and 33 having convex contact surfaces respectively 30A and 33A. The contact surfaces 30A and 33A are convergent in the direction of movement T of the rod-like articles 3. The pusher elements 30 and 33 are attached to the swinging arms 31 and 34 which are self-aligning and attached to the pivots 32 and 35. The swinging arms 31 and 34 are mechanically coupled with each other by means of a strand 36. The swinging arms 31 and 34 connected by an articulated joint and the strand 36 form a lever mechanism 38 ensuring making swinging movements in opposite directions. The pressing of the contact surfaces 30A and 33A against the ends of the rod-like articles 3 is ensured by a pneumatic actuator 37 whose piston rod is attached to the strand 36. In this case, the force acting on the rod-like article 3 may remain at a principally constant level.

The centering apparatus 1D shown in FIG. 5 in a fourth embodiment is provided with the pusher elements 40 and 43 to which rotating pushing rollers 45 and 46 are attached. During the movement of the rod-like article 3 in the direction T, the corresponding parts of the circumferential contact surfaces 45A and 46A positioned convergently relative to the direction T push the ends of the rod-like articles in order to position them symmetrically to the symmetry plane S. The pusher elements 40 and 43 are attached to the swinging arms 41 and 44 which are self-aligning and attached to the pivots 42 and 45. The swinging arms are coupled with each other by means of toothed wheel sectors situated at the ends of the arms 41 and 44. On the element 46, attached to the swinging arm 44, acts a dynamic element in the form of a magnet 47 whose task is to force the movement of the pushing rollers 45 and 46 in the direction of the ends of the rod-like article.

FIG. 6 shows a multi-stage unit for cutting the rod-like articles used on the drum conveyor on a tobacco industry machine. In this embodiment, the cutting takes place in two stages, i.e. at two units. The first-stage unit C1 of the multi-stage cutting unit comprises the centering apparatus 1A and a rotary knife 51.

The second-stage unit C2 of the multi-stage cutting unit comprises at least one centering apparatus 1E designed similar to the apparatus 1A and at least one rotary knife 51. The centering apparatus 1E is adapted with its dimensions to a half of the length of the rod-like article 3. The multi-stage unit for cutting the rod-like articles may also be composed of other centering apparatuses described above. The multi-stage unit shown in FIG. 6 is provided to cut the rod-like article 3 into four parts; at the first-stage unit C1 the rod-like article 3 is centered relative to the plane S and cut into two parts left part 3L and right part 3R. The left part 3L is centered relative to the plane SL and cut into two parts left part 3LL and right part 3LR. The right part 3R is centered relative to the plane SR and cut into two parts left part 3RL and right part 3RR. The rod-like article 3, during the movement on the drum conveyor 2, is centered relative to the plane S and cut by the rotary knife 51; the formed parts 3L and 3R are spaced using spacing means, for example in the form of a spacing wedge 52. Similarly, at the second-stage unit the part 3L is centered relative to the plane SL and cut by the rotary knife 51; the formed parts 3LL and 3LR may be spaced by means of the spacing wedge 52. The part 3R is centered relative to the plane SR and cut by the rotary knife 51; the formed parts 3RL and 3RR may be spaced by means of the spacing wedge 52. The parts formed during the cutting may be spaced using other known spacing means, for example in the form of known slidable segments holding the parts by negative pressure. In the embodiment shown, the parts 3L and 3R are cut on one drum conveyor 5. A similarly designed multi-stage unit for cutting the rod-like articles was shown in FIG. 7, with the spacing means being integrated with the rotary knife 54 in the form of a thickening of the central part of the knife. Such thickening may be designed as conical rollers 55 attached to the flat rotary knife, with the conical angle of the rollers 55 being obtuse to facilitate the spacing of cut parts.

It is possible to design the multi-stage cutting unit on separate conveyor drums as shown in FIGS. 8 and 9. The first cutting stage is carried out on the drum 5A by means of the centering apparatus 1A. After cutting the rod-like article 3 with the rotary knife 51 into two parts 3L and 3R, at the second cutting stage, the parts 3L remain on the drum 5A and are centered by means of the centering apparatus 1EL. The parts 3LL and 3LR formed as a result of cutting the part 3L with the knife 51 are transferred to the drum 5D. The parts 3R are transferred from the drum 5A to the drum 58 and, at the second cutting stage, are centered by means of the centering apparatus 1ER. The parts 3RL and 3RR formed as a result of cutting of the part 3R with the knife 51 are transferred to the drum 5C.

FIGS. 10 and 11 show the groups of rod-like articles which may be centered by means of the centering apparatus according to the invention and cut by means of the multi-stage cutting unit according to the invention.

FIG. 12 shows an example of division of the rod-like article 3. The unit provided to carry out such division has three stages. The designation 61 indicates a rod-like article cut into eight parts.

The centering of the rod-like article ensures a repeatable situation of the rod-like article in the flute of the drum. After the centering, the article may be cut into any number of parts. FIG. 13 shows the division of the rod-like article 3 into five parts, the designation 62 indicates the rod-like article cut into five parts, the unit provided to carry out such division has two stages, whereas at the first stage two rotary knives are used.

The invention claimed is:

1. An apparatus for axial centering of a rod-like article or a group of rod-like articles that have the same or varying lengths, the apparatus comprising:

a drum conveyor;

a flute situated on the circumference of the drum conveyor, a shifting mechanism comprising pusher elements configured to axially act on the rod-like article or the group of rod-like articles so as to change the position of the rod-like article or the group of rod-like articles in the flute, wherein the pusher elements are configured to make swinging movements having opposite senses, the pusher elements have contact surfaces adapted to axially act on the rod-like article or the group of rod-like articles when the pusher elements make the swinging movements having opposite sense, with the contact surfaces of the pusher elements being convergently positioned in a conveying direction of the rod-like articles or the group of rod-like articles, with at least one pusher element being connected with a dynamic element placing the pusher elements in a position to axially act on the rod-like articles or the groups of rod-like articles conveyed on the drum conveyor so that the centers of the rod-like articles or the groups of rod-like articles are positioned principally in a common plane.

2. The apparatus of claim 1, wherein the pusher elements are coupled by toothed wheel sectors.

3. The apparatus of claim 1, wherein the pusher elements are coupled by a lever coupling.

4. The apparatus of claim 1, wherein the pusher elements are coupled by the dynamic element.

5. The apparatus of claim 1, wherein the dynamic element is configured so that the contact surfaces of the pusher elements are shifted towards the ends of the rod-like article.

6. The apparatus of claim 1, wherein the pusher elements are configured to make swinging movements in the range between 0.5° and 6°.

7. The apparatus of claim 1, wherein the dynamic element is an element selected from a group comprising a spring, a pneumatic element and a magnet.

8. The apparatus of claim 1 further comprising immovable guides situated on two sides of the drum conveyor configured so that the rod-like articles or the groups of rod-like articles are provisionally positioned before the contact with the contact surfaces.

9. The apparatus of claim 1 further comprising rotary knives situated so that they cut the rod-like articles or the groups of rod-like articles after their centers have been positioned in a common plane.

10. The apparatus of claim 9, wherein the rotary knives provided to cut the rod-like articles or the groups of rod-like articles are situated behind the pusher elements.

11. A multi-stage unit for cutting rod-like articles of a tobacco industry wherein the rod-like articles or groups of the rod-like articles are conveyed in a flute situated on a circumference of a drum conveyor and are, wherein the rod-like articles or the groups of the rod-like articles in the successive flutes have the same or varying length, the multi-stage unit comprising:

a first centering apparatus comprising the apparatus according to claim 1 mating with a first rotary knife so that the rod-like articles or the groups of the rod-like articles are cut in a centering plane into two parts or groups, left and right, the first centering apparatus and the first rotary knife forming a first-stage unit; and at least one second centering apparatus comprising the apparatus according to claim 1 placed behind the first centering apparatus so that it centers respectively at least one of the parts, left or right, of the cut rod-like article or the groups of the cut rod-like articles conveyed in the flute situated on the circumference of the drum conveyor, wherein the second centering apparatus respectively mates with a second rotary knife which cuts the at least one of the two parts or groups, left or right, of the cut rod-like articles or the groups of the cut rod-like articles in a centering plane of such part or group, the at least one second centering apparatus and the second rotary knife forming a second-stage unit.

12. The multi-stage unit of claim 11, comprising at least two second-stage units disposed downstream of the first-stage unit in the direction of conveying of the rod-like articles or the groups of rod-like articles.

13. The multi-stage unit of claim 11, wherein the first-stage unit further comprises a spacing module disposed downstream of the first rotary knife, the spacing module spacing the two parts of the rod-like articles or the two groups of the rod-like articles cut by the first rotary knife.

14. The multi-stage unit of claim 12, wherein the first rotary knife has surfaces provided to space the two parts or groups of the cut rod-like articles, and wherein the second rotary knives of the at least two second-stage units have surfaces provided to space the at least one of the two parts or groups, left or right, cut in the centering plane of such part or group.

* * * * *